US005853879A

United States Patent [19]

Takamiya et al.

[11] Patent Number: 5,853,879

[45] Date of Patent: Dec. 29, 1998

[54] HIGH MOISTURE-ABSORBING AND RELEASING FIBERS AND PROCESSES FOR THEIR PRODUCTION

[75] Inventors: Hiroyuki Takamiya; Yohko Yamamoto; Masao Ieno, all of Okayama, Japan

[73] Assignee: Toyo Boseki Kabushiki Kaisha, Osaka, Japan

[21] Appl. No.: 753,637

[22] Filed: Nov. 27, 1996

[30] Foreign Application Priority Data

Nov. 29, 1995 [JP] Japan ..... 7-310605

[51] Int. Cl.[6] ..... D02G 3/00

[52] U.S. Cl. ..... 428/364; 428/395; 428/394; 8/115.65; 264/182; 264/345

[58] Field of Search ..... 428/364, 375, 428/394; 8/115.51, 115.65; 525/329.1, 329.2, 329.3; 264/182, 345

[56] References Cited

U.S. PATENT DOCUMENTS

| | | | |
|---|---|---|---|
| 4,143,200 | 3/1979 | Radlmann et al. | 428/388 |
| 4,331,732 | 5/1982 | Palethorpe | 428/364 |
| 4,442,173 | 4/1984 | Takegami et al. | 428/398 |
| 4,562,114 | 12/1985 | Sawanishi et al. | 428/398 |
| 4,600,407 | 7/1986 | Huber | 428/364 |
| 5,109,028 | 4/1992 | Tanaka et al. | 521/32 |
| 5,292,822 | 3/1994 | Tanaka et al. | 529/329.1 |
| 5,494,746 | 2/1996 | Shiraga et al. | 428/359 |

FOREIGN PATENT DOCUMENTS

| | | |
|---|---|---|
| 0 722 004 A2 | 7/1996 | European Pat. Off. . |
| 52-107042 | 9/1977 | Japan . |
| 63-31522 | 2/1988 | Japan . |
| 1-299624 | 12/1989 | Japan . |
| 5-132858 | 5/1993 | Japan . |
| 7-216730 | 8/1995 | Japan . |
| 1447536 | 8/1976 | United Kingdom . |

OTHER PUBLICATIONS

Kobunishi Kagaku, vol. 23, No. 252, (1966), pp. 194–204.

*Primary Examiner*—William Krynski
*Assistant Examiner*—J. M. Gray
*Attorney, Agent, or Firm*—Foley & Lardner

[57] ABSTRACT

High moisture-absorbing and releasing fibers exhibiting excellent moisture-absorbing properties and moisture-releasing properties, capable of withstanding repeated use, having both flame resistance and antibacterial properties, and further having excellent whiteness and workability, as well as processes for their production, are provided. These fibers are made from acrylic fibers and have been particularly adjusted to have an increase in nitrogen content by hydrazine crosslinking, amounts of salt type carboxyl groups and amido groups, tensile strength, limited oxygen index (LOI), sterilization rate, amount of heat evolved by moisture absorption, and whiteness. The production of these fibers are achieved by hydrazine crosslinking treatment, acid treatment, alkali treatment, and conversion of carboxyl groups into those of the salt type. The above fibers can be used for various purposes and can find an enlarged range of applications.

9 Claims, 1 Drawing Sheet

HIGH MOISTURE-ABSORBING AND RELEASING FIBERS AND PROCESSES FOR THEIR PRODUCTION

FIELD OF THE INVENTION

The present invention relates to high moisture-absorbing and releasing fibers. More particularly, it relates to improved high moisture-absorbing and releasing fibers having excellent workability in addition to flame resistance and antibacterial properties, and further having improved whiteness and moisture-absorbing and releasing properties as compared with the conventional products. The present invention further provides processes for their production.

BACKGROUND OF THE INVENTION

As the conventional means of removing moisture in the air, there have been used moisture absorbents such as lithium chloride, calcium chloride, magnesium chloride and phosphorus pentoxide. These moisture absorbents can rapidly absorb moisture in large quantities; however, they become liquefied upon moisture absorption because of deliquescence, which causes contamination of the surroundings and makes it difficult to work them into any shape or form and to remove the absorbed moisture (hereinafter referred to as reconditioning). In contrast, moisture absorbents such as silica gel, zeolite, sodium sulfate, activated alumina and activated carbon can only absorb moisture in small quantities at a low speed and requires high temperatures for reconditioning. Thus both kinds of moisture absorbents meet with many difficulties when put to practical use for various purposes.

For the purpose of overcoming these difficulties, there has been proposed the use of water-absorbing resins mixed with deliquescent salts (see, e.g., JP-A 52-107042 and JP-A 63-31522). To make moisture adsorbents in the form of sheets, non-woven cloths or the like by this technique, they should be dispersed in, sandwiched between or wrapped in the sheets, non-woven cloths or the like, which causes many problems that the moisture adsorbents are liable to come off, the products have unsatisfactory ability to absorb moisture, and their working into the above forms requires laborious steps.

As a solution of these problems, there has been proposed the impregnation of high water-absorbing fibers with deliquescent salts (see, e.g., JP-A 1-299624). The fibers obtained by this technique have practical performance in that they can readily be worked into knitted or woven cloths, non-woven cloths or the like, and they can absorb or release moisture at a high speed, and further in that they are free from the separation of moisture absorbents. They, however, become adhesive when allowed to cause moisture absorption because of hydrogels on the fiber surface, so that they are difficult to find applications, particularly such as wall paper and wadding. Moreover, they have neither frame resistance nor antibacterial properties, which have been increasingly requested as the social needs in recent years.

A process for producing high moisture-absorbing and releasing fibers which meet with these requests has been proposed in the assignees co-owned JP-A 5-132858. In this method, when the amount of salt type carboxyl groups exceeds 4.5 meq/g, the resulting fibers have not more than 1 g/d of tensile strength, which makes their physical properties insufficient to withstand various types of working and which also becomes a barrier to further enhance the moisture absorption rate. Moreover, when the content of nitrogen introduced by treatment with a hydrazine compound to obtain high moisture-absorbing fibers having not less than 1 g/d of tensile strength is allowed to exceed over 8.0% by weight, the amount of salt type carboxyl groups introduced after hydrolysis becomes decreased, which gives reduced rates of moisture absorption.

Furthermore, the fibers obtained by the method disclosed in JP-A 5-132858 have an additional drawback that they exhibit a color of dark pink to dark brown and they can, therefore, only find applications in the limited fields.

OBJECTS OF THE INVENTION

The present invention, which can solve the problems of prior art as described above, provides improved high moisture-absorbing and releasing fibers and processes for their production, which fibers, even when the amount of salt type carboxyl groups introduced exceeds 4.5 meq/g, can have excellent physical properties, very excellent moisture-absorbing properties as compared with the conventional products, ability to absorb or release moisture at a high speed, easy handling properties, excellent retention of form after moisture absorption, easy reconditioning properties, flame resistance and antibacterial properties, along with high whiteness.

This object as well as other objects and advantages of the present invention will become apparent to those skilled in the art from the following description.

SUMMARY OF THE INVENTION

The present inventors have extensively studied for high moisture-absorbing and releasing fibers having excellent physical properties and high whiteness even when the amount of salt type carboxyl groups exceeds 4.5 meq/g. As a result, they have succeeded in obtaining improved high moisture-absorbing and releasing fibers comprising a crosslinked acrylic fiber having 1.0% to 10.0% by weight increase in the content of nitrogen introduced by crosslinking treatment with a hydrazine compound, the acrylic fiber comprising 1.0 to 10.0 meq/g of salt type carboxyl groups introduced by conversion of part of remaining nitrile groups and further comprising at least one of acid type carboxyl groups and amido groups introduced by conversion of the rest of remaining nitrile groups, when present; the high moisture-absorbing and releasing fibers having not lower than 1 g/d of tensile strength, not less than 24 of limit oxygen index, not less than 90% of sterilization rate, 130 to 800 cal/g dry fiber as the amount of heat evolved when allowed to cause moisture absorption under standard conditions of 20° C. and 65% RH (hereinafter referred to as the amount(s) of heat evolved by moisture absorption), and whiteness corresponding to not less than 8 of brightness and not more than 5 of chroma.

They have further found that such fibers can be obtained in an industrially favorable manner by the particular processes for their production, comprising subjecting an acrylic fiber to crosslinking treatment with a hydrazine compound so that increase in nitrogen content by introduction of crosslinking bonds falls within the range of 1.0% to 10.0% by weight; and subjecting the crosslinked acrylic fiber to acid treatment and then alkali hydrolysis so that 1.0 to 10.0 meq/g of salt type carboxyl groups are introduced by conversion of part of remaining nitrile groups and at least one of acid type carboxyl groups and amido groups are introduced by introduction of the rest of remaining nitrile groups, when present.

DETAILED DESCRIPTION OF THE INVENTION

Figure 1:
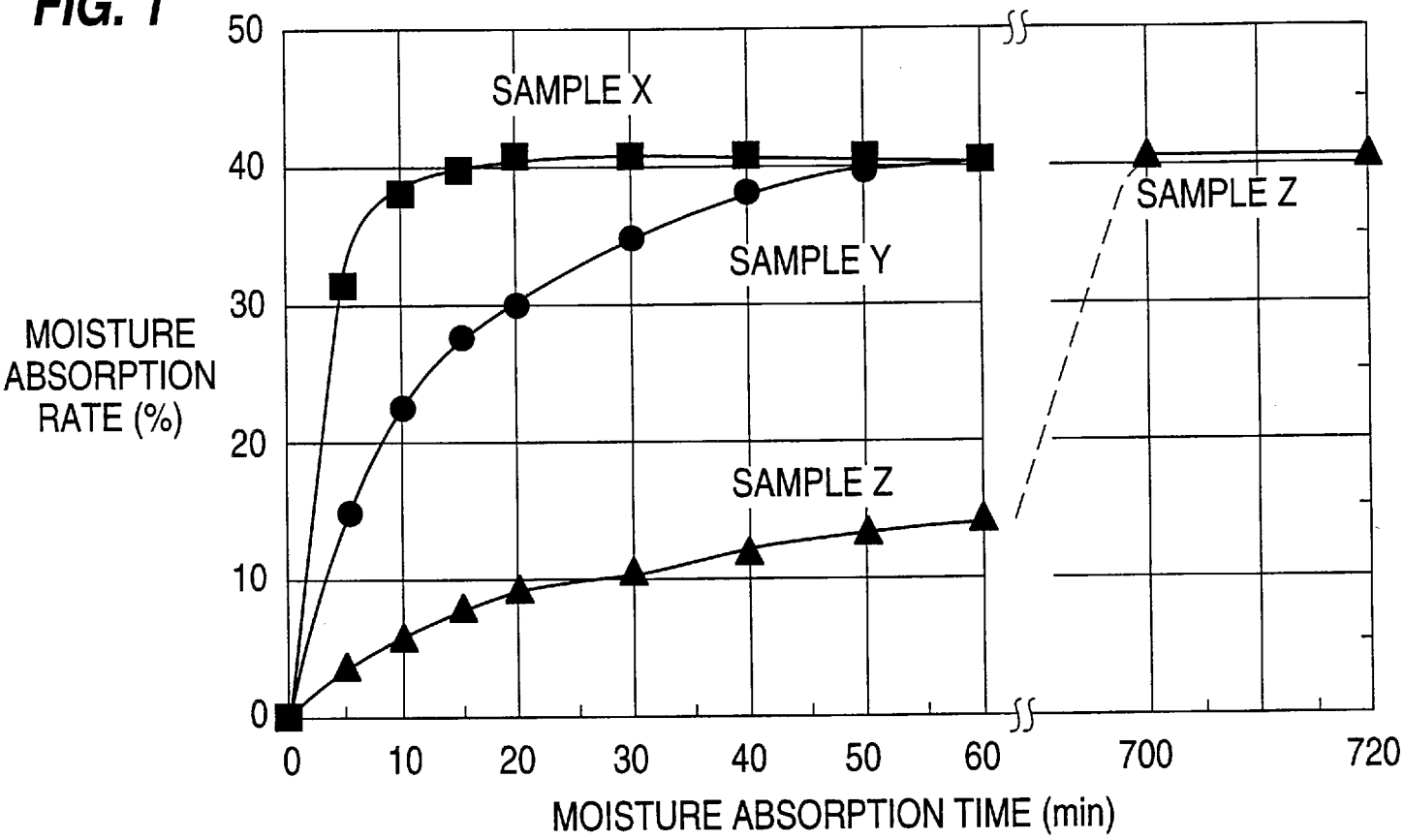
FIG. 1 is a graph showing the relationship between the moisture absorption rate and the moisture absorption time with respect to three products wrought in the fiber of the present invention and designated by "X", "Y" and "Y".

The following will explain the present invention in detail.

First, various terms used for carboxyl groups in the present invention will be defined below.

The term "acid type carboxyl groups" refers to those of the hydrogen (H) type, in which —$COO^-$ residues are combined with hydrogen ions. The term "salt type carboxyl groups" refers to those where —$COO^-$ residues are combined with cations other than hydrogen ions. The term "carboxyl groups" refers to all types of carboxyl groups including —$COO^-$ residues.

The fibers of the present invention comprises crosslinked acrylic fibers. As the starting acrylic fibers, there can be mentioned fibers made of an acrylonitrile polymer containing not less than 40% by weight, preferably not less than 50% by weight, of acrylonitrile. The starting fibers may be in any form, such as staples, tows, threads, knitted or woven cloths, non-woven cloths or the like. They may also be intermediate fibers in the production process or waste fibers. The acrylonitrile polymers may be either homopolymers or copolymers of acrylonitrile. The additional monomers to be used in the copolymers are not particularly limited, so long as they are copolymerizable with acrylonitrile. Examples of the additional monomers may include vinyl halides and vinylidene halides; (meth)acrylic esters; sulfonic group containing monomers and salts thereof, such as methallyl sulfonic acid and p-styrenesulfonic acid; carboxylic group containing monomers and salts thereof, such as (meth) acrylic acid and itaconic acid; and other monomers such as acrylamide, styrene and vinyl acetate.

For introduction of crosslinking bonds in the acrylic fibers with a hydrazine compound, any method can be employed, so long as it is a technique capable of adjusting the increase in nitrogen content to 1.0% to 10.0% by weight. Particularly preferred for industrial use is a technique which includes the treatment of acrylic fibers with a hydrazine compound in a concentration of 5% to 60% at 50° to 120° C. within 5 hours. The term "increase in nitrogen content" or "increase in the content of nitrogen" refers to a difference in nitrogen content between the starting acrylic fibers and the acrylic fibers crosslinked with a hydrazine compound.

When the increase in nitrogen content is below the above lower limit, the resulting fibers cannot have satisfactory physical properties for practical use and they have neither flame resistance nor antibacterial properties. In contrast, when the increase in nitrogen content exceeds the above upper limit, the resulting fibers cannot have excellent moisture-absorbing and releasing properties. The hydrazine compounds to be used in the present invention are not particularly limited, so long as they ensure that the nitrogen content falls within the above range. Examples of the hydrazine compounds may include hydrazine hydrate, hydrazine sulfate, hydrazine hydrochloride, hydrazine hydrobromide and hydrazine carbonate, and may further include compounds containing two or more amino groups, such as ethylenediamine, guanidine sulfate, guanidine hydrochloride, guanidine phosphate and melamine.

As a method for substantially removing, by hydrolysis, the nitrile groups remaining uncrosslinked after the crosslinking treatment with a hydrazine compound, and introducing 1.0 to 4.5 meq/g of salt type carboxyl groups by conversion of part of the remaining nitrile groups and further introducing amido groups by conversion of the rest of the remaining nitrile groups, when present, there has been employed so far heat treatment of the starting fibers impregnated with or dipped into aqueous basic solutions of alkali metal hydroxides, ammonia or the like, or aqueous solutions of mineral acids such as nitric acid, sulfuric acid or hydrochloric acid. Alternatively, hydrolysis may be carried out at the same time as the above introduction of crosslinking bonds, or when hydrolysis is carried out with an acid, the carboxyl groups need to be converted to those of the salt type. With the use of these methods, however, when the amount of salt type carboxyl groups introduced exceeds 4.5 meq/g, the resulting fibers have not more than 1 g/d of tensile strength, which is insufficient to withstand working into various forms. Moreover, these methods only provide fibers having a color of dark pink to dark brown, which can only be used in the limited fields independent of colors.

The present inventors have found that the above problems can be solved by employing a process comprising introduction of crosslinking bonds by treatment with a hydrazine compound, subsequent acid treatment, and then hydrolysis with an alkali as the method for introducing salt type carboxyl groups by conversion of part of the remaining nitrile groups after the crosslinking treatment with a hydrazine compound, and further introducing at least one of acid type carboxyl groups and amido groups by conversion of the rest of the remaining nitrile groups, when present. They have also found that the acid concentration used in the acid treatment after the introduction of crosslinking bonds and the alkali concentration used in the hydrolysis can be reduced as compared with the conventional process in which one-step hydrolysis is carried out, and salt type carboxyl groups can readily be introduced in large quantities by the above conversion, and high moisture-absorbing and releasing fibers having sufficient strength to withstand working and improved whiteness can be obtained.

Examples of the acid to be used in the present invention may include, but not particularly limited to, aqueous solutions of mineral acids such as nitric acid, sulfuric acid and hydrochloric acid, and organic acids. The hydrazine compounds remaining after the crosslinking treatment are to be fully removed before the acid treatment. The alkali to be used are not particularly limited, so long as they are hydrolyzable alkalis, examples of which may include aqueous basic solutions of alkali metal hydroxides, alkaline earth metal hydroxides, ammonia or the like. The acid and alkali concentrations to be used are also not particularly limited, and from the viewpoint of production on industrial scale and physical properties, both concentrations are preferably set in the range of 1% to 10% by weight and used for treatment at 50° to 200° C. within 2 hours. If further limited, the acid treatment and alkali hydrolysis are preferably carried out at concentrations of 1% to 5% by weight The method for converting carboxyl groups to those of the salt type is not particularly limited, so long as it makes possible that the amount of salt type carboxyl groups falls within the range of 1.0 to 10.0 meq/g. The fibers after the alkali hydrolysis are preferably washed with water and dried.

The carboxyl groups may also be converted to those of the salt type by dipping the above hydrolyzed fibers in an aqueous solution of various salt type hydroxides or salts, followed by water washing and drying. As the salt type carboxyl groups, there can be mentioned alkali metals containing cations such as lithium (Li), sodium (Na) and potassium (K), cations of alkaline earth metals such as beryllium (Be), magnesium (Mg), calcium (Ca) and barium (Ba, cations of), other metals such as copper (Cu), zinc (Zn), aluminum (Al), manganese (Mn), silver (Ag), iron (Fe), cobalt (Co) and nickel (Ni), ammonium ion ($NH_4$) and organic cations such as amine.

The carboxyl groups may also be converted to those of the salt type by changing carboxyl groups to acid type carboxyl groups through additional acid treatment subsequent to the alkali hydrolysis and then converting the acid type carboxyl groups to the salt type carboxyl groups through the salt treatment or alkali treatment as described above. In this case, when the amount of salt type carboxyl groups falls within the range of 1.0 to 10.0 meq/g, there is no need to convert all the carboxyl groups to those of the salt type and the amount of salt type carboxyl groups may be adjusted, if necessary, by the addition of an acid to the salt type carboxyl groups.

The salt type carboxyl groups are not limited to only one salt type, and two or more salt types may be used in combination. So long as the amount of salt type carboxyl groups introduced falls within the range as defined in the present invention, there is no need to change all the carboxyl groups present in the fibers to those of the salt type and some acid type carboxyl groups may remain unchanged in the fibers.

The fibers of the present invention are obtained by chemical modification of acrylic fibers. In such modified fibers, part of the remaining nitrile groups after the crosslinking treatment with a hydrazine compound have been converted to the salt type carboxyl groups, and the rest of the remaining nitrile groups, when present, have been converted to at least one of acid type carboxyl groups and amide groups. Thus substantially all the nitrile groups have been consumed.

When the amount of salt type carboxyl groups is less than 1.0 meq/g, the resulting fibers cannot have excellent moisture-absorbing and releasing properties. When the amount of salt type carboxyl groups is more than 10.0 meq/g, the resulting fibers cannot have satisfactory physical properties for practical use. An important feature of the present invention is in that even when the amount of salt type carboxyl groups exceeds 4.5 meq/g, the resulting fibers can have satisfactory physical properties that have not been attained by the conventional fibers such as disclosed in JP-A 5-132858; particularly the whiteness of the fibers is remarkably improved as compared with the conventional fibers. According to the production processes of the present invention, even when the amount of salt type carboxyl groups is adjusted to fall within the range of 1.0 to 4.5 meq/g, it is possible to obtain fibers having not only improved whiteness but also further improved physical properties and moisture-absorbing and releasing properties as compared with the conventional fibers.

The following will explain the improvement of whiteness as described herein. The fibers obtained in JP-A 5-132858 have a color of dark pink to dark brown, whereas the fibers obtained by the process of the present invention have a color of very pale pink to very pale brown, which color can be further improved to white. With the expression of whiteness using an index of JIS-Z-8721, the fibers obtained in JP-A 5-132858 has a color with about 5.5 of brightness and about 11 of chroma, which color can be improved by the present invention to whiteness corresponding to not less than 8 of brightness and not more than 5 of chroma. Thus the fibers of the present invention can also find various applications attaching much importance to their colors in the fields requiring high moisture-absorbing and releasing properties as well as high amounts of heat evolved by moisture absorption. Examples of such applications may include articles of clothing and materials for interior decoration, such as sweaters, mufflers, towels, mats, curtains and wallpaper.

The term "brightness" refers to an attribute of color, which is distinguished by the degree of lightness, ranging from "10" for the achromatic ideal white to "0" for the achromatic ideal black, and which is evaluated by division with an equal difference in the sense of lightness. The values of brightness for chromatic colors are defined by the values of brightness for achromatic colors giving the equivalent sense of lightness. The term "chroma" refers to an attribute of color, which is distinguished by the degree of vividness and which is evaluated at an equal step from "0" for achromatic colors with an increase in the degree of vividness. Furthermore, each of the chromatic colors has an additional attribute of color, which is called "hue" characteristic of the color, such as red (R), yellow (Y), green (G), blue (B) or purple (P). Thus colors with high whiteness regardless of hue have high values of brightness and low values of chroma.

The present invention males it possible to provide high moisture-absorbing and releasing fibers having improved whiteness, not less than 1 g/d of tensile strength, ability to absorb or release moisture at a high speed, as well as both flame resistance and antibacterial properties. In particular, when high tensile strength is desired, fibers having high dichromatic ratio are preferably selected for the starting acrylic fibers as described below.

More particularly, it is desirable that acrylic fibers composed of well oriented acrylonitrile polymer molecules and having not less than 0.4, more preferably not less than 0.5, of Congo red (hereinafter referred to as CR) dichromatic ratio are employed. The CR dichromatic ratio is determined by the method described in Kobunshi Kagaku, 23 (252) 193 (1966).

The method for preparing such acrylic fibers is not particularly limited, and any known method can be suitably used, so long as the above CR dichromatic ratio is obtained. In particular, with the use of any method in which the total draw ratio is not less than 6, preferably not less than 8, and the shrinkage ratio in the step is not more than 30%, preferably not more than 20%, the desired acrylic fibers can be prepared in an industrially favorably manner.

Such fibers are preferably used as the starting fibers, which may be either intermediate fibers in the production of acrylic fibers or finished fibers after worked by spinning or the like. The use of drawn fibers before heat treatment (fibers obtained by spinning a spinning dope of acrylonitrile polymers by conventional procedure, and then drawing the spun filaments for orientation, but not carrying out any heat treatment such as dry heat densification or wet heat relaxation treatment; in particular, water-swollen gel-like fibers after wet or dry/wet spinning and drawing, the degree of water swelling being 30% to 150%) as the starting acrylic fibers is desirable because the dispersibility of the fibers in the reaction solution and the permeability of the reaction solution in the fibers are improved and the introduction of crosslinking bonds and the hydrolysis reaction are carried out in a uniform and rapid manner.

From various points of view, such as apparatus, safety and uniformity of reaction, it is desirable that these starting acrylic fibers are charged in a vessel equipped with a pump circulating system, followed by the introduction of crosslinking bonds, acid treatment, alkali treatment, formation of salt type carboxyl groups, water washing, oil treatment and other steps. Examples of such apparatus (i.e., vessel equipped with a pump circulating system) may include dyeing machines.

The fibers of the present invention can have sufficient tensile strength to withstand working, high whiteness, as well as both flame resistance and antibacterial properties, so long as the amount of salt type carboxyl groups introduced, even when it exceeds 4.5 meq/g, is not more than 10.0 meq/g, which has not been achieved by the conventional moisture-absorbing and releasing fibers. The fibers of the present invention have very high moisture absorption rates and can readily be reconditioned. Thus the fibers of the present invention exhibit high amounts of heat evolved by moisture absorption because of high performance on moisture absorption, which has not been achieved by the conventional fibers. The term "amount(s) of heat evolved by moisture absorption" refers to the amount(s) of heat evolved from 1 g of fibers dried at 105° C. over 16 hours when allowed to cause moisture absorption under the standard conditions of 20° C. and 65% RH. The fibers of the present invention exhibit very high amounts of heat evolved by moisture evolution in the range of 130 to 800 cal/g, as compared with 108 cal/g for wool fibers, 76 cal/g for down feathers and 47 cal/g for cotton fibers, all of which have been said to have high amounts of heat evolved by moisture absorption.

Since the fibers of the present invention exhibit high heat evolution, they can find various applications for which the conventional fibers have never been used or in which remarkably improved performance is utilized as compared with the conventional fibers. Examples of such applications may include materials for prevention of moisture condensation by absorbing water vapor before the moisture condensation and causing heat evolution; warm material utilizing heat evolution by moisture absorption, such as articles of clothing, materials for interior decoration, wallpaper and wadding; and materials for control of environmental moisture and temperature. The fibers of the present invention can also be used as drying and dehumidifying materials for closets, basements, underfloors, bathrooms and the like, or components of covering materials for electronic parts which may be possibly damaged by moisture. These fibers are highly hydrophilic, so that they can also find applications for absorbing moisture and releasing water vapor. Such effects can be further enhanced by the starting fibers talking the form of fine denier fibers, hollow fibers, porous fibers or the like. It is also effective for this purpose that the fibers are formed into fibrillated fibers, raised or flocked cloths or paper, or the like.

The fibers of the present invention have excellent performance on moisture release as compared with the conventional moisture absorbents. In other words, the fibers of the present invention can be reconditioned even at low temperatures as compared with the conventional moisture absorbents such as silica gel, zeolite, sodium sulfate, activated alumina, activated carbon, lithium chloride, calcium chloride, magnesium chloride and phosphorus pentoxide. The conventional moisture absorbents require high temperatures, e.g., 120° C., for reconditioning, whereas the fibers of the present invention can be reconditioned even at low temperatures, e.g., 50° C. The feature of reconditioning at low temperatures indicates that the fibers of the present invention are not limited to industrial use and they can also be handled with safety for domestic use. Moreover, such reconditioning at low temperatures makes it possible to recondition the fibers by the use of waste heat from various machines, and the fibers of the present invention can also be used as moisture-absorbing materials of the energy saving type.

The fibers of the present invention are high moisture-absorbing and releasing fibers; however, they do not become sticky to the touch upon moisture absorption and they have moderate moisture content and exhibit moderate elongation. The fibers of the present invention are, therefore, moist and flexible fibers. These properties can be used for applications such as moisture-keeping materials, materials for beauty and materials of excellent texture. The fibers of the present invention are also advantageous, when used for cloths, paper or the like, which are then impregnated with hydrophilic chemicals or the like, in that they can be made into materials having high degrees of impregnation and being difficult to get dry because of high moisture retention. Examples of the applications may include those impregnated with disinfectant solutions, face lotions, aromatics, deodorants, bactericides, fungicides, insecticides or the like.

The moisture-absorbing and releasing properties are mainly expressed by the salt type carboxyl groups in the fibers of the present invention. The moisture-absorbing and releasing properties can be controlled by controlling the amount of salt type carboxyl groups. The moisture-absorbing and releasing properties can also be controlled, for example, by introducing carboxyl groups in large quantities by hydrolysis and controlling the amount of carboxyl groups converted to those of the salt type. When such a method is employed, various methods can be taken, for example, hydrolysis with an alkali, which is followed by metal salt treatment and acid treatment; however, they are not particularly limited, so long as the amount of salt type carboxyl groups falls within the range of 1.0 to 10.0 meq/g. From an industrial point of view, the preferred methods for controlling the amount of salt type carboxyl groups may include alkali hydrolysis, additional acid treatment, and metal salt treatment in the presence of an alkali, or alkali treatment.

The fibers of the present invention exhibit high speed of moisture absorption and release, which can be controlled, for example, by the density of the fibers or the density of products obtained by working of the fibers. When very high speed of moisture absorption and release is required, various methods can be employed, for example, using fine-denier high moisture-absorbing and releasing fibers; using fibrillated high moisture-absorbing and releasing fibers; lowering the fiber density; and carrying out raising or flocking to increase the area of high moisture-absorbing and releasing fibers coming in contact with a moisture-containing gas. When low speed of moisture absorption and release is required, various methods can be employed, for example, increasing the fiber density by using increased density in the working of the fibers into non-woven cloths or paper, or by using a large number of twists in the spinning; using thick-denier high moisture-absorbing and releasing fibers; and covering the fibers of the present invention with another substance having permeability to water vapor. Examples of the applications in the latter case may include, but not limited to, long-term utilization of heat evolved by moisture absorption.

In the high moisture-absorbing and releasing fibers of the present invention, the moisture-absorbing and releasing properties are not limited to absorption and release of water vapor in the air, but can also be used for moisture absorption and release of various water vapor-containing gases. Examples of such gases may include, but not limited to, water vapor-containing hydrocarbon gases such as methane gas, ethane gas, propane gas, butane gas, ethylene gas and acetylene gas, hydrogen gas, carbon dioxide gas, carbon monoxide gas, helium gas, nitrogen gas, oxygen gas, argon gas, hydrogen sulfide gas, nitrogen oxide gases, ammonia gas, and other various mixed gases.

The fibers of the present invention have excellent moisture-absorbing and releasing properties and high whiteness, as well as high flame resistance and antibacterial properties. The term "flame resistance" as used herein refers to having greater than 20 of limit oxygen index (LOI) as defined in JIS-K-7201. The fibers of the present invention exhibit flame resistance corresponding to not less than 24 of limit oxygen index, which is greater than the value in the above definition. The antibacterial properties are expressed in sterilization rate when measured by the shake flask method described below. The fibers of the present invention exhibit not less than 90% of sterilization rate.

The fibers of the present invention have these characteristics, so that they can be handled with very safety. The ordinary fibers will provide a preferred environment for the growth of bacteria upon moisture absorption, and from a hygienic point of view, they should often be used in combination with fibers having antibacterial properties or other materials. In contrast, the fibers of the present invention have excellent performance in that they need no particular such combined use. The fibers of the present invention have flame resistance, so that there is not the slightest fear of fire even when high temperatures are applied to the fibers for reconditioning or the like, and they are very safe materials even for domestic use.

The material used in the fibers of the present invention has a crosslinked structure with excellent resistance to chemicals, so that the fibers can retain their fiber form even when treated with various chemicals. Therefore, the fibers of the present invention can also be used as supports for structural materials including acids or alkalis.

The reasons why the fibers of the present invention have high moisture-absorbing and releasing properties, along with flame resistance, have not yet been fully elucidated; however, they can be generally considered as follows.

That is, the fibers of the present invention, although they are prepared from acrylonitrile polymers as the starting materials, contain substantially no nitrile groups. It, therefore, seems that the side chains attached to the polymer chains are mainly composed of crosslinked structures, which contain nitrogen atoms introduced by the reaction with a hydrazine compound, and salt type carboxyl groups formed by the hydrolysis of the nitrile groups.

In general, salt type carboxyl groups have moisture-absorbing properties. The fibers of the present invention contain them in very large quantities and also have a nitrogen-rich crosslinked structure. It is, therefore, believed that their moisture-absorbing properties are further enhanced. Furthermore, speaking from inference, the conditions that those carboxyl groups are of the salt type and that the fibers have a moderate crosslinked structure may suppress the mechanism that functional groups, which should be concerned in the moisture-absorbing properties, make no contribution on the moisture-absorbing properties because of hydrogen bonding between them, and may, therefore, provide the fibers having very high moisture-absorbing and releasing properties. The reason why the fibers of the present invention exhibit very high amounts of heat evolved by moisture absorption is believed that they are high moisture-absorbing and releasing fibers and they can adsorb water vapor at amounts depending upon the relative humidity in the surroundings, at which time there is evolved adsorption heat substantially equal to latent heat by vaporization of water.

The mechanism by which the fibers of the present invention have improved whiteness has not yet been elucidated. It seems that the acid treatment subsequent to the crosslinking treatment with a hydrazine compound makes an improvement in whiteness. The mechanism for such control of color development is supposed to include the addition of an acid to a resonance structure moiety concerned in the color development, before the structure crosslinked with a hydrazine compound is colored by oxidation or the like.

The acid treatment after the crosslinking treatment also causes the hydrolysis of some nitrile groups remaining unreacted with a hydrazine compound. This reaction is not necessarily required to convert the nitrile groups to carboxyl groups, and may only convert the nitrile groups to amido groups. It is believed that this acid treatment facilitates the subsequent alkali hydrolysis and the nitrile groups can be converted into carboxyl groups even when the reagent used in the alkali hydrolysis has a low concentration.

The fibers of the present invention may have tensile strength sufficient to withstand various working even when they contain salt type carboxyl groups in large quantities. This would be explained as follows. In the conventional methods, hydrolysis is carried out by one-step reaction, and the introduction of salt type carboxyl groups at desired amounts is achieved by increasing the concentrations of reagents for hydrolysis, raising the reaction temperature, prolonging the reaction time, or other techniques. The hydrolysis is thus carried out under severe conditions, and it is, therefore, supposed that the introduction of salt type carboxyl groups at amounts exceeding 4.5 meq/g gives not more than 1 g/d of tensile strength, which gives physical properties insufficient to withstand working. In contrast, the process of the present invention involves two-step hydrolysis by acid treatment and alkali treatment, so that the reaction of hydrolysis proceeds stepwise and the reagents for hydrolysis can be reduced to the concentrations very lower than those for the one-step reaction. It is, therefore, supposed that the fibers of the present invention have high tensile strength even when they contain salt type carboxyl groups in large quantities. Of course, the oriented structure as determined by the CR dichromatic ratio makes a great contribution to working performance which also arises from the crosslinked structure.

The antibacterial properties are supposed to result from the nitrogen-containing crosslinked structure. Furthermore, the reason why the fibers of the present invention have no sticky to the touch even when allowed to cause moisture absorption is that they have been crosslinked to a considerable extent.

The reason for high flame resistance, although it has not yet been elucidated, may include the incorporation of salt type carboxyl groups in very large quantities, high content of nitrogen, and suppression of temperature rise because of very high moisture absorption rate.

EXAMPLES

The present invention will be further illustrated by the following Examples, in which parts and percentages are all by weight unless otherwise indicated.

The amount of salt type carboxyl groups, whiteness, amount of heat evolved by moisture absorption, moisture absorption rate, LOI (limit oxygen index) as the measure of flame resistance, and antibacterial properties were determined as follows.

(1) Amount of salt type carboxyl groups (meq/g)

About one gram of well dried test fiber was precisely weighed (X g), to which 200 ml of water was added, and the mixture was adjusted to pH 2 by the addition of 1N aqueous hydrochloric acid solution, while warming to 50° C. A titration curve was then obtained with 0.1N aqueous sodium hydroxide solution by conventional procedure. From the titration curve, the amount of aqueous sodium hydroxide solution consumed by carboxyl groups (Y cc) was obtained. The amount of carboxyl groups (in meq/g) was calculated by the following equation:

$$\text{Amount of carboxyl groups}=0.1\ Y/X$$

A titration curve was obtained in the same manner as described above, except that the test mixture was not adjusted to pH 2 by the addition of 1N aqueous hydrochloric acid solution, and the amount of acid type carboxyl groups (in meq/g) was calculated by the following equation:

$$\text{Amount of salt type carboxyl groups}=\text{Amount of carboxyl groups}-\text{Amount of acid type carboxyl groups}$$

(2) Whiteness

The whiteness was evaluated according to "indication with three attributes of color" as defined in JIS-Z-8721, and expressed by "hue, brightness/chroma".

(3) Amount of heat evolved by moisture absorption (cal/g)

One gram of fiber dried at 105° C. over 16 hours was allowed to cause moisture absorption under the standard conditions of 20° C. and 65% RH, at which time the amount of heat evolved was measured by a dual-type conduction calorimeter.

(4) Moisture absorption rate (%)

About 5.0 g of sample fiber is dried in a hot-air dryer at 120° C. for 5 hours, and weighed ($W_1$ g). The sample was then placed in a hygrostatic chamber at 20° C. for 24 hours. The sample having thus caused moisture absorption was weighed ($W_2$ g). The moisture absorption rate was calculated by the following equation:

$$\text{Moisture absorption rate}=\{(W_2-W_1)/W_1\}\times 100$$

(5) LOI

The measurement of LOI was followed by the procedure for determining minimum oxygen indices as defined in JIS-K7201.

(6) Antibacterial properties

Using Pneumobacillus as the test bacteria, the measurement was followed by the shake flask method described in the manual of an evaluation test for treatment effects of antibacterial/deodorizing-treated articles (Sen'i-seihin Eisei Kako Kyogi-kai, 1988), and the results are shown in terms of sterilization rate (%).

EXAMPLE 1

A spinning dope obtained by dissolving 10 parts of acrylonitrile polymer (intrinsic viscosity [η] in dimethylformamide at 30° C., 1.2) composed of 90% acrylonitrile and 10% methyl acrylate in 90 parts of 48% aqueous sodium rhodanide solution was spun by conventional procedure, drawn (total draw ratio, 10 times), and dried (shrinkage in the step, 14%) under an atmosphere at dry bulb/wet bulb temperatures=120° C./60° C. to give starting fibers (CR dichromatic ratio, 0.58) having 1.5 d of filament fineness.

The starting fibers were subjected to crosslinking treatment and introduction of carboxyl groups under the conditions shown in Table 1, followed by dehydration, water washing and drying, which afforded fibers No. 1 to 8. The resulting fibers were examined for physical properties, and the results are shown in Table 1.

TABLE 1

| | | | Examples | | | | Comparative Examples | | | |
|---|---|---|---|---|---|---|---|---|---|---|
| | | | Fiber No. 1 | Fiber No. 2 | Fiber No. 3 | Fiber No. 4 | Fiber No. 5 | Fiber No. 6 | Fiber No. 7 | Fiber No. 8 |
| Crosslinking treatment | Treatment with hydrazine hydrate | (%) | 35 | 35 | 8 | 35 | 35 | 35 | 6.4 | 35 |
| | | (°C.) | 98 | 98 | 120 | 100 | 98 | 98 | 102 | 120 |
| | | (hr) | 3 | 3 | 3 | 3.5 | 5 | 3 | 5 | 5 |
| Conversion to carboxyl groups | Acid treatment with nitric acid | (%) | 5 | 4 | 2 | 5 | — | — | 5 | 5 |
| | | (°C.) | 90 | 90 | 100 | 90 | — | — | 90 | 90 |
| | | (hr) | 2 | 2 | 0.5 | 2 | — | — | 2 | 2 |
| | Alkali treatment with NaOH | (%) | 4 | 5 | 2.5 | 5 | 10 | 10 | 5 | 5 |
| | | (°C.) | 90 | 93 | 100 | 85 | 90 | 90 | 90 | 90 |
| | | (hr) | 1.5 | 2 | 0.5 | 2 | 2 | 2 | 2 | 2 |
| Performance of high moisture-absorbing and releasing fibers | Increase of nitrogen content | (%) | 4.2 | 4.2 | 8.3 | 5.0 | 5.3 | 4.2 | 0.5 | 10.7 |
| | Amount of salt type carboxyl groups | (meq/g) | 6.3 | 8.7 | 3.7 | 3.8 | 3.7 | 4.7 | 9.1 | 0.3 |
| | Tensile strength | (g/d) | 1.3 | 1.3 | 1.7 | 1.9 | 1.2 | 0.6 | 0.6 | 2.4 |
| | Whiteness (visual appreciation) (hue, brightness/chroma) | | very pale pink 5R, 9/2.5 | very pale pink 5R, 9/2.5 | pale brown 2.5YR, 8/3 | very pale pink 5R, 9/2 | dark pink 2.5R, 6/11 | dark pink 10RP, 5.5/11 | pale pink 5R, 8/3 | pale 2.4YR, 8.5/3 |
| | Amount of heat evolved by moisture absorption | (cal/g) | 404 | 605 | 264 | 265 | 238 | 304 | 560 | 115 |
| | Moisture absorption rate | (%) | 60 | 89 | 39 | 39 | 35 | 45 | 83 | 17 |
| | Flame resistance | (LOI) | 29 | 30 | 27 | 28 | 27 | 26 | 19 | — |
| | Antibacterial properties, sterilization rate | (%) | 92 | 92 | 97 | 94 | 95 | 91 | not more than 10 | — |

As can be seen from Table 1, fibers No. 1 and 2 of the present invention, although the amount of sodium (Na) type carboxyl groups introduced was greater than 4.5 meq/g, exhibited high tensile strength, high whiteness and large amount of heat evolved by moisture absorption, as well as both flame resistance and antibacterial properties. Fiber No. 3 of the present invention, although it had an increase in nitrogen content over 8%, had introduced sodium (Na) type carboxyl groups and it, therefore, exhibited high tensile strength, high whiteness and large amount of heat evolved by moisture absorption, as well as both flame resistance and antibacterial properties. Fibers No. 3 and 4 of the present invention, although they were at the same level with respect to the amount of sodium (Na) type carboxyl groups as the conventional fibers, exhibited very high whiteness and high tensile strength.

In contrast, fibers No. 5 and 6 prepared without acid treatment as comparative examples had dark pink color, which cannot be applied to any filed requiring whiteness. Fiber No. 6 as another comparative example, although it was subjected to the same crosslinking treatment as in the cases of fibers No. 1 and 2 and then alkali treatment with NaOH at a higher concentration than those used in the cases of fibers No. 1 and 2, had introduced sodium (Na) type carboxyl groups in small quantities and exhibited 0.6 g/d of tensile strength. This fiber was, therefore, liable to break and had no physical properties sufficient to withstand working such as carding.

Fiber No. 7 as still another comparative example having a smaller increase in nitrogen content than those found in the fibers of the present invention had 0.6 g/d of tensile strength and it was, therefore, a fiber difficult to withstand working, which further had poor antibacterial properties.

Fiber No. 8 as still another comparative example having a larger increase in nitrogen content than those found in the fibers of the present invention had salt type carboxyl groups in small quantities, low moisture absorption rate, and small amount of heat evolved by moisture absorption.

EXAMPLE 2

Five grams of fiber No. 1 obtained in Example 1 was dipped in 1 liter of 5% aqueous solution of each salt shown in Table 2 at 40° C. for 5 hours, followed by water washing and drying, which afforded fibers No. 9 and 10 of different salt types. The resulting fibers were examined for physical properties, and the results are shown in Table 2.

TABLE 2

| | Examples | |
|---|---|---|
| | Fiber No. 9 | Fiber No. 10 |
| Salt | KCl | LiCl |
| Amount of salt type carboxylic groups (meq/g) | 6.3 | 6.3 |
| Tensile strength (g/d) | 1.4 | 1.3 |
| Whiteness | | |
| (visual appreciation) | very pale brown | very pale pink |
| (hue, brightness/chroma) | 2.5 YR, 9/2 | 5 R, 9/2 |
| Amount of heat evolved by moisture absorption (cal/g) | 413 | 431 |
| Moisture absorption rate (%) | 61 | 64 |
| Flame resistance (LOI) | 28 | 29 |
| Antibacterial properties sterilization rate (%) | 92 | 92 |

As can be seen from Table 2, both fibers were high moisture-absorbing and releasing fibers having high whiteness and large amount of heat evolved by moisture absorption, as well as both antibacterial properties and flame resistance.

EXAMPLE 3

Five grams of fiber No. 1 obtained in Example 1 was adjusted to pH 2 by additional acid treatment with hydrochloric acid, followed by water washing, and then dipped in an aqueous KCl solution at 0.04 mol/l, to which an aqueous KOH solution was added for adjustment to a prescribed pH shown in Table 3, followed by water washing and drying, which afforded fibers No. 11 and 12 having different amounts of potassium (K) type carboxyl groups. The resulting fibers were examined for physical properties, and the results are shown in Table 3.

TABLE 3

| | Examples | |
|---|---|---|
| | Fiber No.11 | Fiber No.12 |
| pH adjusted by aq. KOH | 6.5 | 7.0 |
| Amount of salt type carboxylic groups (meq/g) | 4.0 | 4.8 |
| Tensile strength (g/d) | 1.4 | 1.3 |
| Whiteness | | |
| (visual appreciation) | very pale pink | very pale pink |
| (hue, brightness/chroma) | 5 R, 9/2 | 5 R, 9/2 |
| Amount of heat evolved by moisture absorption (cal/g) | 270 | 341 |
| Moisture absorption rate (%) | 40 | 50 |
| Flame resistance (LOI) | 27 | 28 |
| Antibacterial properties, Sterilization rate (%) | 92 | 91 |

As can be seen from Table 3, the amount of heat evolved by moisture absorption can also be controlled by adjusting the amount of carboxyl groups converted to those of the salt type by acid treatment, alkali hydrolysis, and additional acid treatment.

EXAMPLE 4

Five grams of fiber No. 1 obtained in Example 1 and 5 g of silica gel were well dried in a hot air dryer at 120° C., and then allowed to stand in a thermo-hygrostatic chamber at 20° C., 90% RH for 24 hours, at 20° C., 65% RH for 1 hour, at 20° C., 45% RH for 1 hour, and at 20° C., 10% RH for 1 hour. These samples were examined for moisture absorption rates under the respective humidities, and the results are shown in Table 4.

TABLE 4

| | Moisture absorption rate (%) | |
|---|---|---|
| Relative humidity (%) | Fiber No. 1 | Silica gel |
| 90 | 103 | 35 |
| 65 | 60 | 32 |
| 45 | 35 | 28 |
| 10 | 5 | 22 |

As can be seen from Table 4, fiber No. 1 was rapidly reconditioned even in a quick change of circumstances such that the humidity was decreased every one hour. In other words, the fibers of the present invention have excellent performance on moisture release.

EXAMPLE 5

The starting fiber (CR dichromatic ratio, 0.55) was obtained and treated in the same manner as described in Example 1, except that vinylidene chloride was used in place of methyl acrylate.

The resulting fiber exhibited 4.1% of nitrogen content, 6.3 meq/g of sodium (Na) type carboxyl groups, 59% of moisture absorption rate at 65%. relative humidity, 399 cal/g as the amount of heat evolved by moisture absorption, 1.2 g/d of tensile strength, whiteness corresponding to 2.5 YR, 8.5/3

(pale brown), 31 of LOI, and 93% of sterilization rate, which was, therefore, a fiber having high whiteness and excellent moisture-absorbing and releasing properties, as well as both flame resistance and antibacterial properties.

EXAMPLE 6

To a sheet of paper weighing 35 g and having 5.5% of moisture absorption rate was attached 15 g of an adhesive having no moisture-absorbing properties, on which 100 g of fiber No. 1 obtained in Example 1 and cut in 0.7 mm length was flocked to give sample X. Then, 102 g of fiber No. 1 obtained in Example 1 and cut in 5 mm length and 48 g of 2 d×5 mm heat-fused fiber having 0.5% of moisture absorption rate were made in paper form (density, 0.5 g/cm$^3$) to give sample Y. Then, 102 g of fiber No. 1 obtained in Example 1 and cut in 5 mm length and 33 g of 2 d×5 mm heat-fused fiber were made in paper form (density, 0.35 g/cm$^3$), which was wrapped in a porous Teflon film weighing 15 g to give sample Z. These samples were well dried at 105° C. and then examined for the speed of moisture absorption when allowed to cause moisture absorption under the standard conditions. The results are plotted in FIG. 1.

In FIG. 1, the gradient of curves indicates the speed of moisture absorption. As can be seen from this figure, the speed of moisture absorption can be controlled by the method of fabrication or composition even when the moisture absorption rate was equal at equilibrium. At the same time as moisture absorption, there also occurs heat evolution, and it is, therefore, readily supposed that the speed of heat evolution by moisture absorption can also be controlled. Furthermore, the speed of reconditioning can also be controlled as in the control of moisture absorption speed.

As described above, the present invention is particularly advantageous in that it provides high moisture-absorbing and releasing fibers having physical properties which are substantially sufficient for practical use, even when the amount of salt type carboxyl groups is as high as 10.0 meq/g, and further having remarkably improved whiteness; and processes for their production in an industrially favorable manner. The high moisture-absorbing and releasing fibers thus obtained can find, because of improved moisture-absorbing and releasing properties as well as remarkably improved whiteness, various applications for which the conventional fibers have never been used. These fibers further have both flame resistance and antibacterial properties, and they can be reconditioned at low temperatures, and they can be worked into various forms, such as non-woven cloths, knitted or woven cloths. Furthermore, these fibers can be used for various purposes in the fields requiring moisture-absorbing and releasing properties or heat evolution properties because the speed of moisture absorption or release can also be controlled by adjusting the amount of salt type carboxyl groups, thickness and density of the fibers, or the like.

What is claimed is:

1. An improved high moisture-absorbing and releasing fiber comprising a crosslinked acrylic fiber having 1.0% to 10.0% by weight increase in nitrogen content, 1.0 to 10.0 meq/g of carboxyl groups in salt form, and optionally at least one carboxyl group in acid form and amino group, said high moisture-absorbing and releasing fiber having tensile strength not lower than 1 g/d, an oxygen index not less than 24, a sterilization rate not less than 90%, realizing 130 to 800 cal/g dry fiber upon moisture absorption under standard conditions of 20° C. and 65% RH, and whiteness corresponding to not less than 8 of brightness and not more than 5 of chroma, whereby said high moisture-absorbing and releasing fiber is obtained by a crosslinking reaction with a hydrazine compound followed by acid treatment and alkali treatment, respectively.

2. An improved high moisture-absorbing and releasing fiber according to claim 1, wherein the amount of carboxyl groups in salt form is 4.8 to 10.0 meq/g.

3. An improved high moisture-absorbing and releasing fiber according to claim 1, where said carboxyl groups in salt form comprise at least one salt selected from the group consisting of:

lithium, sodium, potassium, beryllium, magnesium, calcium, barium, copper, zinc, aluminum, manganese, silver, iron, cobalt and nickel ions, ammonium ion, and organic cations.

4. A process for producing an improved high moisture-absorbing and releasing fiber as in claim 1 comprising the steps of:

i) crosslinking an acrylic fiber with a hydrazine compound so that nitrogen content of the fiber is increased to a range of 1.0% to 10.0% by weight;

ii) treating said crosslinked acrylic fiber of step (i) with acid;

iii) treating said acrylic fiber of step (ii) with alkali, and iv) adjusting the content of carboxyl groups in salt form in said acrylic fiber of step (iii) by treatment with hydroxide in salt form or salts, or with an acidic solution.

5. A process for producing high moisture-absorbing and releasing fiber according to claim 4, wherein the amount of carboxyl groups in salt form is within a range of 4.8 to 10.0 meq/g.

6. A process for producing high moisture-absorbing and releasing fiber according to claim 4, further comprising an additional acid treatment after said alkali treatment, after which the carboxyl groups in salt form are introduced.

7. A process for producing an improved high moisture-absorbing and releasing fiber as in claim 4, wherein said acid can be at least one from a group of acids comprising:

aqueous solutions of mineral acids and organic acids.

8. A process for producing an improved high moisture-absorbing and releasing fiber as in claim 4, wherein said fiber of step (i) comprises at least 50% by weight acrylonitrile.

9. A process for producing an improved high moisture-absorbing and releasing fiber as in claim 4, wherein said hydrazine used for crosslinking is at a concentration of 5% to 60%, and the treatment occurs at a temperature between 50° C.–120° C. for up to 5 hours.

* * * * *